United States Patent [19]

Fromm

[11] 4,380,255

[45] Apr. 19, 1983

[54] HOOPER APPARATUS

[75] Inventor: Peter Fromm, Uitikon, Switzerland

[73] Assignee: Fromm AG, Spreitenbach, Switzerland

[21] Appl. No.: 294,216

[22] Filed: Aug. 19, 1981

[30] Foreign Application Priority Data

Sep. 5, 1980 [CH] Switzerland ..... 6681/80

[51] Int. Cl.[3] ..... B21F 9/02

[52] U.S. Cl. ..... 140/93.2; 74/661

[58] Field of Search ..... 74/661; 100/32; 140/93, 140/93.2; 464/30, 32, 35, 40; 254/214, 215, 219, 220, 339

[56] References Cited

U.S. PATENT DOCUMENTS 1,900,238 3/1933 Harvey ..... 140/93.2

3,127,790 4/1964 Howey ..... 74/661

*Primary Examiner*—Francis S. Husar

*Assistant Examiner*—Linda McLaughlin

*Attorney, Agent, or Firm*—Toren, McGeady and Stanger

[57] ABSTRACT

Hooper apparatus for joining together a pair of bands including a first motor connected with an output shaft through a plural-stage reduction gear system wherein one gear stage of the system is connected with a second motor which enables a faster driving speed of the apparatus with a lower driving force. A compensating clutch is provided on the driving side of the one gear stage, preferably an overrunning clutch, with the clutch being arranged to be used when the driving speed of the second motor has decreased to an extent that it is overtaken by the driving speed conditional on the first motor which carries a tension roller engaging the bands to be joined. The first motor then operates to drive the output shaft with a lower circumferential speed and with a higher driving force.

10 Claims, 5 Drawing Figures

HOOPER APPARATUS

The present invention relates generally to hooper apparatus and more particularly to apparatus for joining together a pair of band sections.

Hooper devices for joining steel bands of the type mentioned above are known wherein the drive arrangement of such devices is designed in accordance with the maximum driving force applied during tensioning of the bands. This maximum force is usually required at lower driving speeds. However, during advancement of the bands or placement of the bands in a desired position, a high driving speed with a relatively low driving force is required.

The foregoing requirements are met in large driving mechanisms either by means of control gears or by means of complicated control devices provided in the energy supply system for electric or hydraulic motors of the apparatus. Such devices usually involve fairly large and expensive units.

In many cases, hooper devices of the type described above cannot be used because, on the one hand, their structural size is unacceptable and because, on the other hand, the cost of such devices is impractical.

Special problems result in this connection in penumatic drive systems for the hooper apparatus which are designed only for maximum driving force at a correspondingly low speed. For this purpose, the hooper apparatus is provided with a pneumatic motor which acts upon an output shaft by means of a multistage gear system which includes particularly planetary gearing. Such drives are very expensive and also require large air consumption.

The present invention is directed toward provision of a hooper apparatus for joining together steel bands of the type described above wherein it is possible to use a two-stage drive which is relatively simple in its structure.

SUMMARY OF THE INVENTION

Briefly, the present invention may be described as hooper apparatus for connecting steel bands having a band tensioning mechanism comprising motor means including a first motor and a second motor, tension roller means for engaging said bands, said tension roller means being prestressed toward a base support, and plural stage reduction gear means connecting said tension roller means with said motor means, said plural stage reduction gear means including a first gear stage connected with said second motor with one of said motors being connected by means of a compensating clutch.

Hooper apparatus in accordance with the present invention, as compared to conventional devices, will require only an additional motor and a compensating clutch. Since the second motor is used for faster feed operation, the first motor may be designed for high power requirements which may be necessary for operation at extremely low speeds. Due to the appropriate design of the gear section on the driven side, the first motor may be made very small thereby resulting in significant savings despite the fact that two motors are used.

It has been found that particularly when pneumatic motors are used, high speeds with low driving force and low speeds at high driving force can be achieved and that, although two motors are used, it is possible to achieve significant savings in manufacturing expenses.

Additionally, it has been determined, particularly when pneumatic motors are used, that the two motors result in significant savings in air consumption as compared with known pneumatically operated hooper devices, even if the motors run simultaneously.

In accordance with a preferred embodiment of the invention, the compensating clutch comprises a slipping clutch although an overriding clutch, preferably an overrunning clutch, may also be advantageously provided.

Furthermore, the motors of the invention may be designed to be connectable alternatively or successively, although an embodiment wherein the motors can be connected simultaneously is particularly simple and preferred.

Different types of motors may be used and, for example, electric motors are contemplated. The embodiment of the driving mechanism wherein pneumatic motors are utilized is particularly advantageous because a simple construction may be provided which is fully effective. In accordance with a further aspect of the invention, both of the motors may be supplied by means of a common supply line and the motors may be formed with an annular chamber for delivery of compressed air, the annular chamber being connected by means of a connecting line wherein the common supply line discharges into the annular chamber of the second motor.

In accordance with a further improvement of the invention, the supply line of at least one of the motors, preferably of the first motor, may have arranged therein an adjustable throttle valve.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 5:
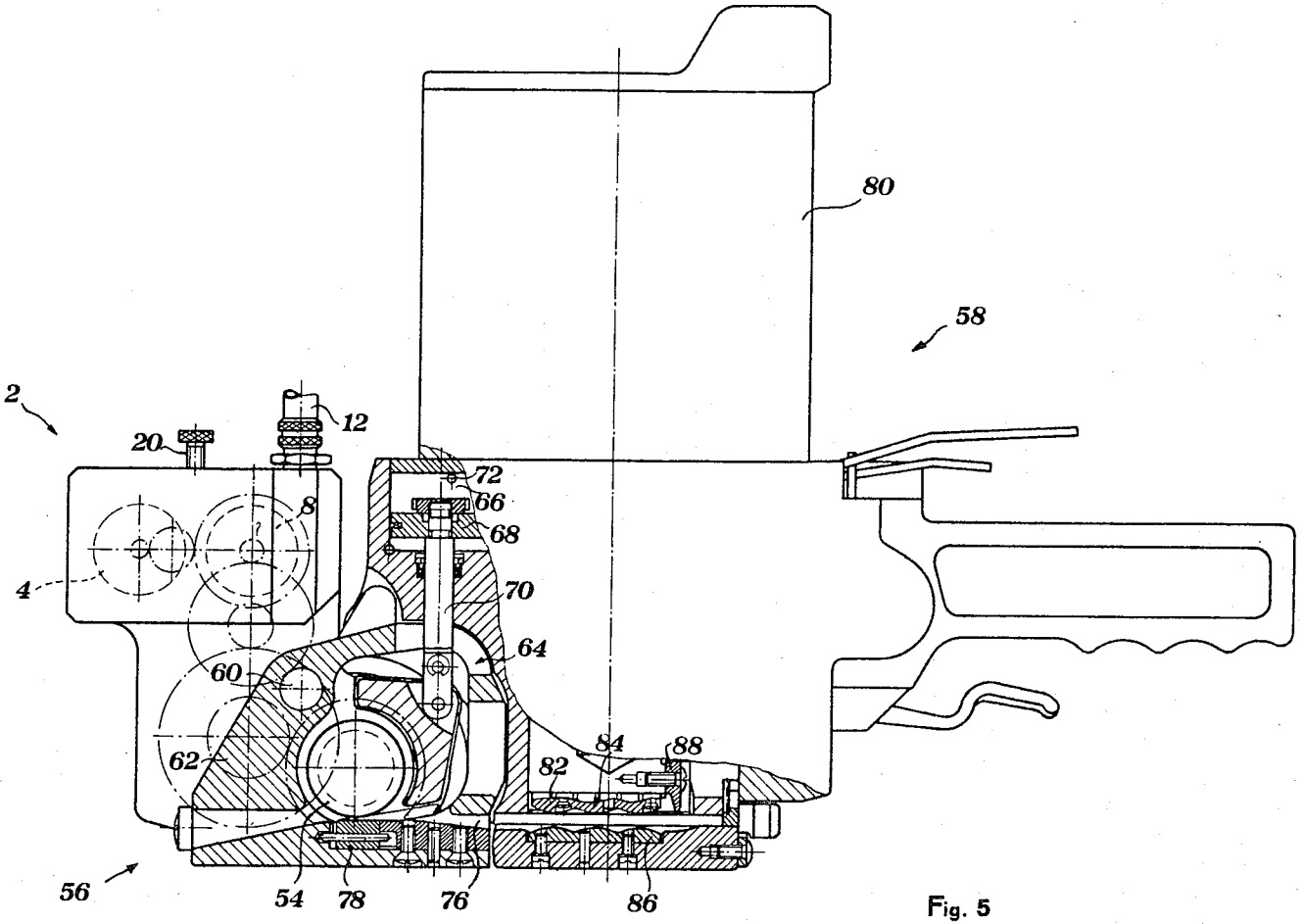
FIG. 5 is a side view, partially cut away, showing the hooper apparatus in accordance with the present invention.

Referring now to the drawings, wherein like reference numerals are used to identify similar parts in the various figures thereof, there is shown a drive 2 for the hooper apparatus of the invention shown in FIG. 5 which is particularly intended for joining together a pair of bands. A first motor 4 drives an output shaft 6 by means of a multistage gear mechanism having gear stages $S_1$ to $S_4$.

A second motor 8 is connected between a first gear stage $S_1$ of the multistage gear system and a second gear stage $S_2$ thereof whereby, in the gear section on the driving side which includes the gear stage $S_1$, a compensating clutch 10 is arranged.

Figure 1:
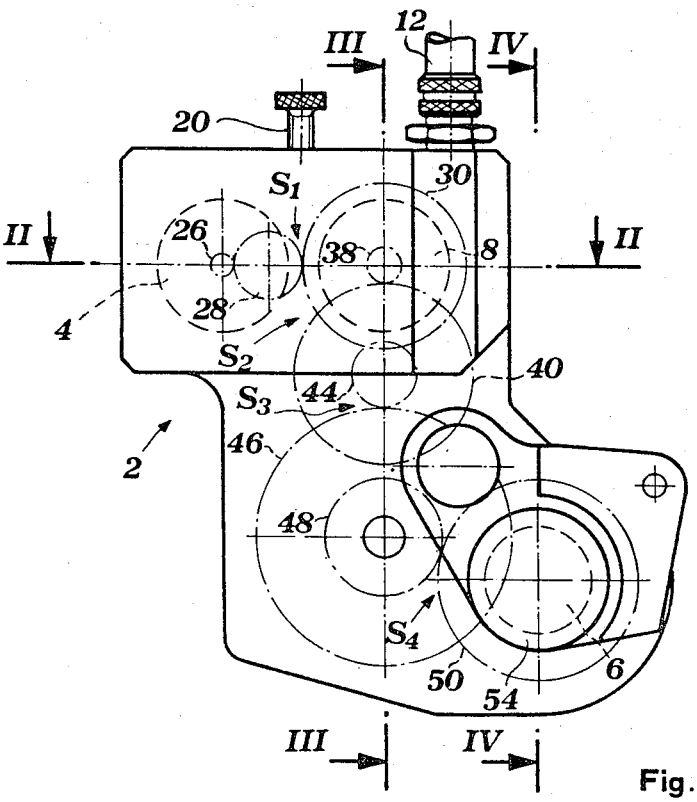
FIG. 1 is a side view of a drive for the hooper apparatus of the invention.
Figure 2:
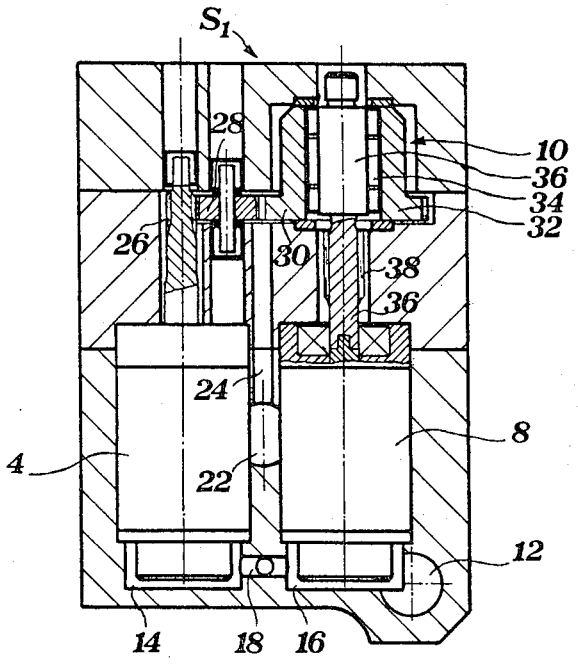
FIG. 2 is a sectional view taken along the line II—II of FIG. 1.
Figure 3:
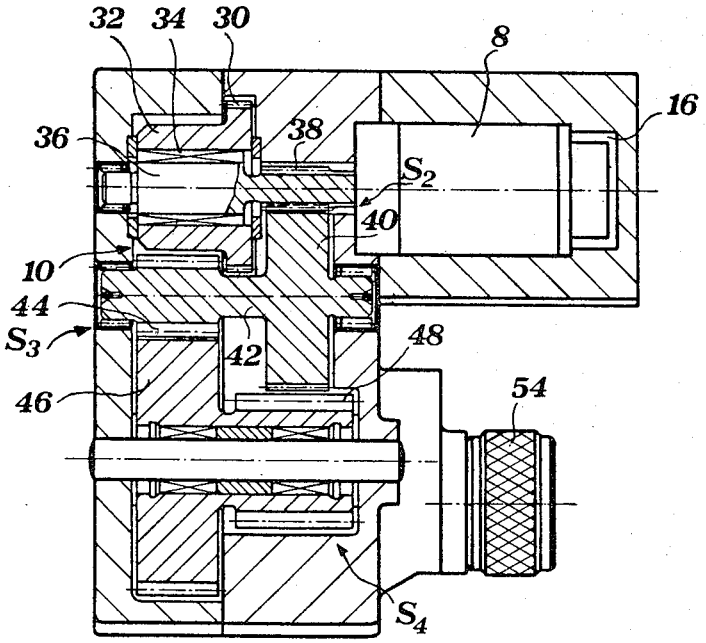
FIG. 3 is a sectional view taken along the line III—III of FIG. 1.
Figure 4:
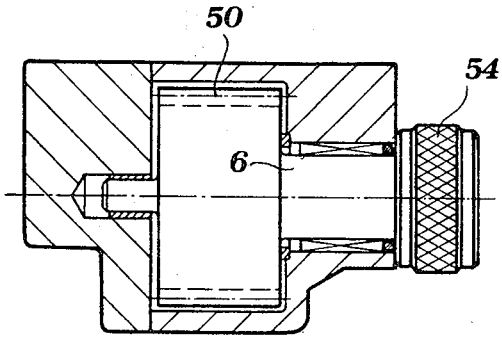
FIG. 4 is a sectional view taken along the line IV—IV of FIG. 1.

As best seen from FIG. 2, the motors 4 and 8 are pneumatic motors which are charged with compressed air by means of a common supply line 12. Annular chambers 14 and 16 of the motors 4 and 8 are connected with each other by means of a connecting duct 18 whereby compressed air flows from the supply line 12 through the annular chamber 16 and the connecting duct 18 into the annular chamber 14. In the connecting duct 18 there is arranged a throttle valve 20 with which the driving force of the first motor may be controlled. A drain line 22 operates to permit exhaust of air from the motors 4 and 8 for removal thereof. A ventilation duct 24 which extends into the space of the gear system serves for ventilation of the gear space.

The first motor 4 operates through a spur gear 26 to drive a change gear 28 which is connected with an additional spur gear 30. The spur gear 30 is arranged at a housing 32 of the compensating clutch 10 which is designed as an overriding clutch, preferably an overrunning clutch. For this purpose, drive rollers 34 act on a shaft 36 of the first gear stage $S_1$.

The shaft 36 is connected with the second motor 8 and also carries a spur gear 38 of the second gear stage $S_2$ which interacts with a spur gear 40. The spur gear 40 is connected by means of a shaft 42 with a spur gear 44 of the third gear stage $S_3$ which, in turn, drives a spur gear 46. The spur gear 46 is finally connected with a spur gear 48 of the fourth gear stage $S_4$ which meshes with a spur gear 50 rigidly arranged for rotation with the output shaft 6. The output shaft 6 carries the tension roller 54 of a band tensioning mechanism 56 of the hooper device 58, as shown in FIG. 5.

In the hooper apparatus 58 of FIG. 5, the housing of the drive 2 is pivotally mounted at an axle 60 of a frame 62 of the hooper device 58. In order to provide swiveling action, a swiveling device 64 is provided which is constructed as a piston-cylinder unit having a piston 68 which moves in a cylinder 66. The piston 68 is hinged by means of a piston rod 70 at the housing of the drive 2. Compressed air connections 72, 74 serve to supply compressed air to the swiveling device 64.

For insertion of two band sections into a receiving slot 76, the drive 2 is lifted by means of the swiveling device 64 so that the tension roller 54 is released from a base support 78. The tension roller 54 then is again engaged by means of the swiveling device 64 and is pressed against the band sections. Subsequently, the compressed air supply is connected to the motors 4, 8 whereby the second motor 8 first drives the tension roller 54 with a lesser force and higher circumferential speed so that the band section in contact with the tension roller 54 is advanced at a high speed.

As soon as the band rests at an object (not shown) to be hooped, the tension roller 54 is braked and consequently so is the motor 8. As soon as the rotational speed has decreased sufficiently that it is below the rotational speed which is imposed by the first motor 4 on the spur gear 30 of the first gear stage $S_1$, the spur gear 30 drives the shaft 36 by means of the driving rollers 34 so that the motor 4 starts to operate and drives the tension rollers 54 with an increased propelling force and with a lesser circumferential speed. The band is tensioned in this manner. The amount of tension may be set by means of the throttle valve 20.

As soon as the band is sufficiently tensioned in the hooper device 58, an upper section 82 of a punching and stamping tool 84 is moved by means of a driving mechanism 80 toward a lower section 86 and the band sections which lie therebetween are provided with a punched and stamped closure. A knife 88 serves to cut a length of band from a supply spool thereof.

The hooper device 58 which has been described serves for processing of steel bands which are provided with punched and stamped closures. The driving mechanism 2 is also suitable for other types of hooper devices utilizing bands in which the band sections which are to be connected are provided with a closure casing or in which band sections of plastic are to be welded together.

The driving mechanism described may also be provided with electric motors instead of the pneumatic motors indicated in the foregoing.

While a specific embodiment of the invention has been shown and described in detail to illustrate the application of the inventive principles, it will be understood that the invention may be embodied otherwise without departing from such principles.

What is claimed is:

1. Hooper apparatus for connecting steel bands having a band tensioning mechanism comprising tension roller means for engaging said bands, motor means including a first motor for driving said tension roller means with low speed at high torque and a second motor for driving said tension roller means with high speed at low torque, said tension roller means being prestressed toward a base support, and plural stage reduction gear means connecting said tension roller means with said motor means, said second motor being connected to any but the first stage of said plural stage reduction gear means, with said first motor being connected via a first stage to said plural stage reduction gear means and with one of said first and second motors being connected by means of a compensating clutch to said plural stage reduction gear means.

2. Apparatus according to claim 1 wherein said compensating clutch is a slipping clutch.

3. Apparatus according to claim 1 wherein said compensating clutch is an overriding clutch.

4. Apparatus according to claim 3 wherein said overriding clutch is an overrunning clutch.

5. Apparatus according to claim 1 wherein said first and said second motors are adpated to be connected simultaneously.

6. Apparatus according to claim 1 wherein said first and second motors are pneumatic motors.

7. Apparatus according to claim 6 wherein both of said first and second motors are supplied by means of a common supply line.

8. Apparatus according to claim 7 wherein each of said first and second motors is formed with an annular chamber for delivery of compressed air, said annular chambers being connected by means of a connecting line, said common supply line discharging into said annular chamber of said second motor.

9. Apparatus according to claim 7 wherein an adjustable throttle valve is arranged in the supply line for at least one of said first and said second motors.

10. Apparatus according to claim 9 wherein said throttle valve is arranged in the supply line for said first motor.

* * * * *